US008636312B2

(12) United States Patent
Eastall

(10) Patent No.: US 8,636,312 B2
(45) Date of Patent: Jan. 28, 2014

(54) LIFTING HOOK WITH BACKSTOP

(75) Inventor: Jonathan F. Eastall, Sherwood (AU)

(73) Assignee: Eastall Precision Engineering Pty Ltd., Coopers Plains (AU)

( * ) Notice: Subject to any disclaimer, the term of this patent is extended or adjusted under 35 U.S.C. 154(b) by 0 days.

(21) Appl. No.: 13/346,773

(22) Filed: Jan. 10, 2012

(65) Prior Publication Data

US 2012/0175901 A1 Jul. 12, 2012

(30) Foreign Application Priority Data

Jan. 12, 2011 (AU) ..... 2011900070

(51) Int. Cl.
*B66C 1/00* (2006.01)

(52) U.S. Cl.
USPC ..... 294/67.21; 294/67.31

(58) Field of Classification Search
USPC ..... 294/67.2, 67.21, 67.22, 67.5, 81.3, 294/67.3, 67.31
See application file for complete search history.

(56) References Cited

U.S. PATENT DOCUMENTS

| | | | | | |
|---|---|---|---|---|---|
| 1,847,819 | A | * | 3/1932 | Davies | 294/67.2 |
| 3,144,088 | A | * | 8/1964 | Kaplan | 177/147 |
| 3,341,243 | A | * | 9/1967 | Archer | 294/67.21 |
| 3,843,185 | A | * | 10/1974 | James et al. | 294/67.21 |
| 4,475,758 | A | * | 10/1984 | Paulsson | 294/67.21 |
| 6,578,892 | B2 | * | 6/2003 | Tsimmerman | 294/67.21 |
| 6,733,058 | B1 | * | 5/2004 | Nakajima | 294/86.41 |

FOREIGN PATENT DOCUMENTS

| | | |
|---|---|---|
| JP | 10087263 | 4/1998 |

* cited by examiner

*Primary Examiner* — Stephen Vu
(74) *Attorney, Agent, or Firm* — Bay State IP, LLC

(57) ABSTRACT

A C-hook for lifting heavy coils, such as coils of steel, includes a lifting frame which has an upper arm that is formed with a lifting point in the form of integrally formed lug for receiving a lifting hook of a crane. A counterweight is fixed at a forward end of the upper arm. The lower end of the frame is formed with a slide that receives a slideable load support member in the form of foot. The foot has a forward front foot end for penetration of the lumen of a coil to be lifted. The opposite, rearward end of the foot is mechanically interlinked by a mechanical linkage to a coil backstop member. The mechanical linkage includes a lever arm, which pivots about a fixed pivot point that is fast with the frame. The foot and backstop member facilitate the balanced transportation of steel coils of varying widths.

6 Claims, 6 Drawing Sheets

LIFTING HOOK WITH BACKSTOP

CROSS REFERENCE TO RELATED APPLICATION

This application takes the benefit of and in turn claims priority under 35 USC §119 to Australian Provisional Patent Application No. 2011900070 filed on Jan. 12, 2011, the contents of which are herein incorporated by reference.

TECHNICAL FIELD

The present invention relates to a lifting hook. Embodiments of the invention are particularly applicable to situations where heavy rolls of material, for example, must be lifted.

BACKGROUND

Any references to methods, apparatus or documents of the prior art are not to be taken as constituting any evidence or admission that they formed, or form part of the common general knowledge.

Sheets of steel may be supplied in the form of coils or rolls. It will be appreciated that these coils are very heavy and typically require the use of a crane to move them. The approach to handling a coil is generally to pass a lower arm of a C-hook through the coil's lumen. The coil is then lifted by a hook attached to a mobile crane or the like. Other heavy loads of similar shape may be handled in like manner. For example, C-hooks may be used to handle concrete pipes and rolls of paper.

It will be realized that the centre or gravity of an unloaded C-hook differs from that of the hook in a loaded state. Consequently, a problem that occurs is that as the loaded C-hook is raised by the crane, the lower arm typically has a tendency to tilt downward toward the mouth of the hook, so that the load may slide off. Where a counterweight is used this tendency may be overcome however in that event the arm may tilt upward where a lighter than expected coil is loaded.

It is an object of the present invention to provide a lifting hook that addresses the above described problem and is an improvement, or at least a useful alternative, to lifting hooks of the prior art.

SUMMARY OF THE INVENTION

According to a first aspect of the present invention there is provided a lifting hook including

- a lifting frame having a lifting point;
- a support member supported by said frame for receiving a lumen of a coil; and
- an adjustable backstop member arranged to abut the coil at a desired position relative to the lifting point to thereby balance said hook when loaded.

The support member is preferably movable relative to the lifting frame.

It is preferable that the adjustable backstop member and the support member are arranged to move in concert to thereby balance said hook about the lifting point.

The adjustable backstop member and the support member may be arranged to move in concert by a mechanical linkage.

In a preferred embodiment the mechanical linkage includes a lever arm that pivots about a point fast with the frame.

The support member is preferably slideable relative to the frame.

Preferably the support member includes a forward end and a rear end wherein the forward end penetrates the lumen and the rear end is linked to a first end of the lever arm.

Preferably the backstop member is linked to a second end of the lever arm opposite the first end.

In a preferred embodiment a link arm is provided with ends pivotally connected fast with the back stop member and the frame respectively.

Preferably the backstop member includes a coil abutment face arranged at a predetermined angle to the support member.

In a preferred embodiment the mechanical linkage describes a parallelogram whereby pivoting of the lever arm advances or retracts the coil abutment face while maintaining the predetermined angle.

The predetermined angle is preferably a right angle between the coil abutment face and the support member.

Engagement formations, for example detents, may be provided for selectively positioning the support member relative to the lifting frame.

A counterweight may be provided for assisting in balancing the lifting hook about the lifting point.

The lifting point may comprise a shackle attached to the frame. Alternatively, the frame may be shaped to provide an integrated lifting point for attachment of a lifting hook.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
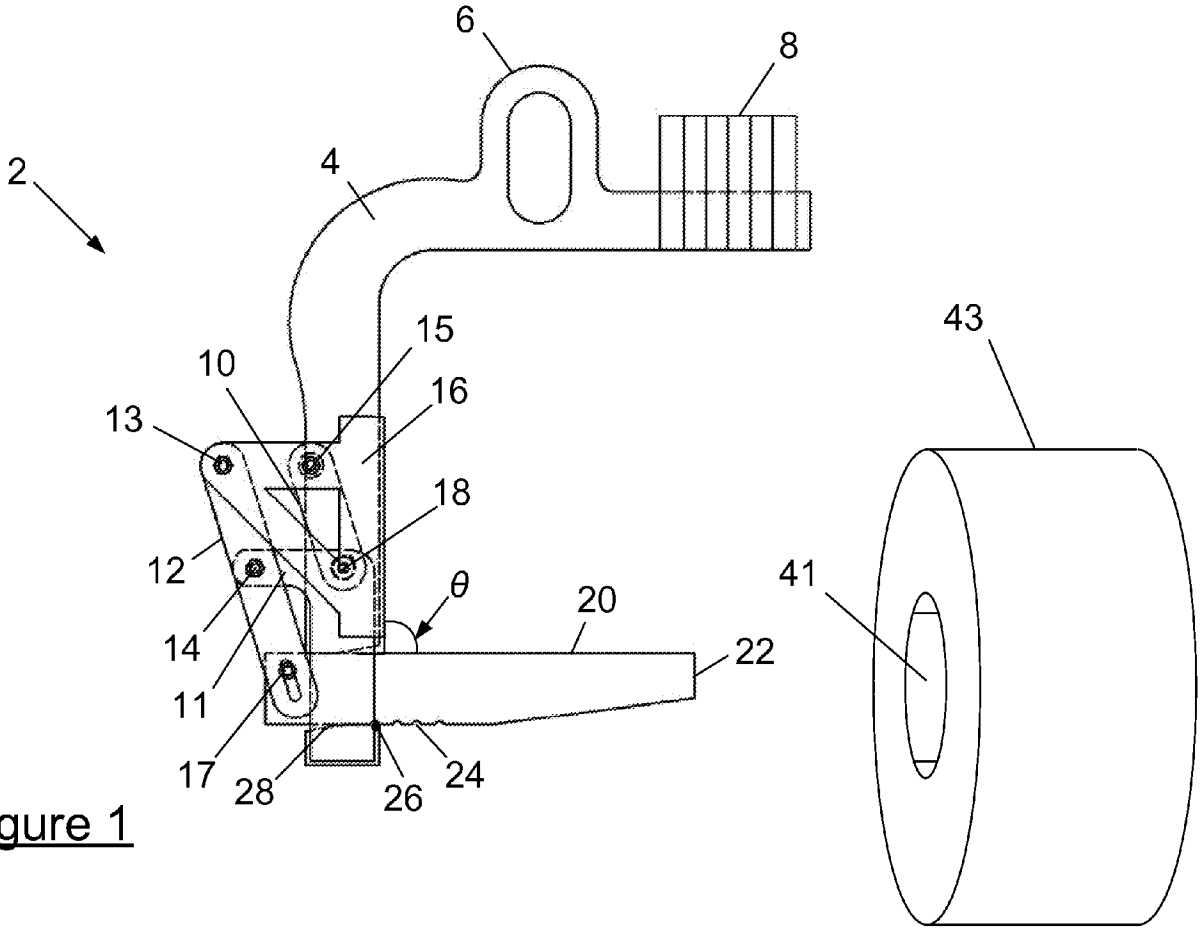
FIG. 1 is a side plan elevation of a C-hook according to a preferred embodiment of the present invention.
Figure 3:
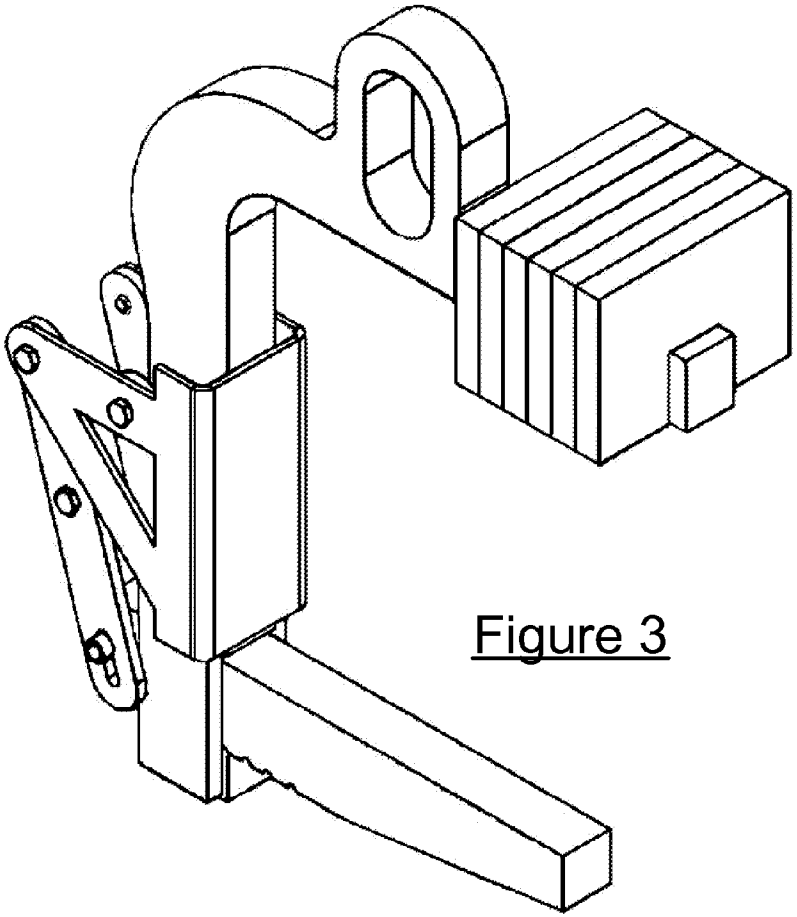
FIG. 3 is an isometric view of the C-hook.
Figure 2:
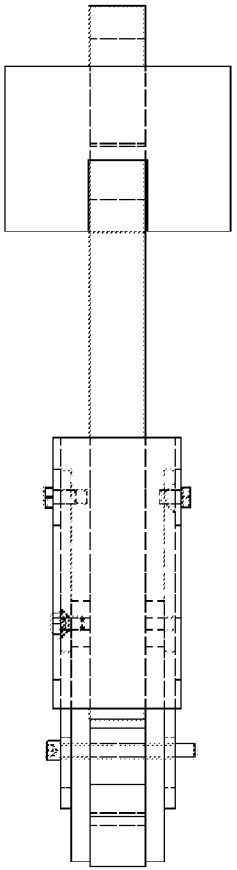
FIG. 2 is front plan elevation of the C-hook.

Referring now to FIG. 1, there is depicted a C-hook 2 according to a preferred embodiment of the present invention in an unloaded state.

Figure 7:
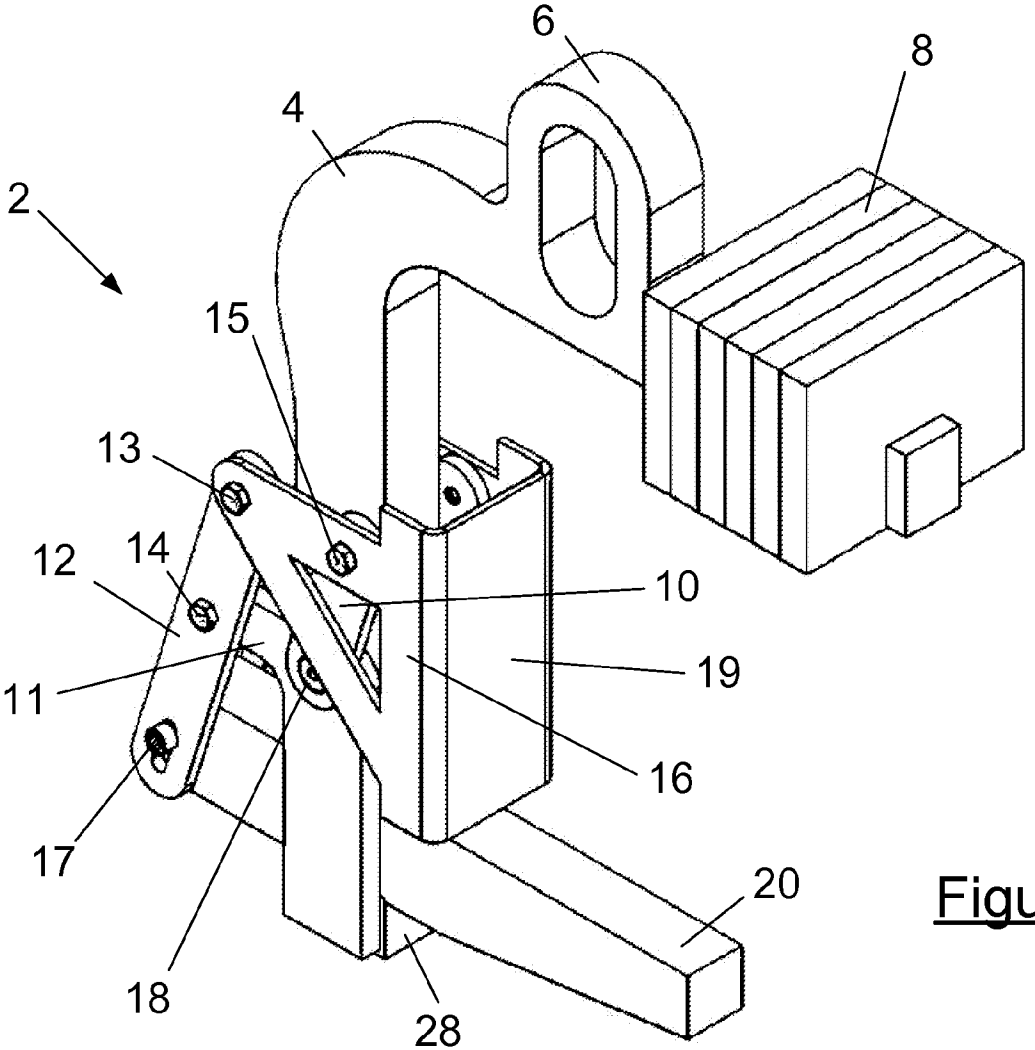
FIG. 7 is an isometric view of the C-hook in the second configuration.

The C-hook includes a lifting frame 4, which has an upper arm that is formed with a lifting point in the form of integrally formed lug 6 for receiving a lifting hook of a crane. A counterweight 8 is fixed at a forward end of the upper arm. A slide 28 is fastened to the lower end of the frame 4, as best seen in FIG. 7. The slide 28 bears a slideable load support member in the form of foot 20.

The foot 20 has a forward front foot end 22 for penetration of the lumen of a coil to be lifted. The opposite, rearward end of the foot is mechanically interlinked by a mechanical linkage to a coil backstop member 16. The backstop member has a forward face 19 for abutting a loaded coil in use. The mechanical linkage includes a lever arm 12, which pivots about a fixed pivot point 14 that is fast with the frame 4. In the presently described embodiment the fixed pivot point 14 is formed on an arm 11 that extends rearward from the slide 28, which is in turn mounted fast to the frame 4 as previously mentioned.

An upper end of the lever arm 12 is coupled to pivot point 13 which is fast with the backstop member 16. A lower end of the lever arm 12 is formed with a slot that slidingly captures a pin 17 that extends from the rear end of adjustable foot 20. The mechanical linkage further comprises a link arm 10 that is pivotally connected at opposite ends to the backstop member 16, by pivot 15, and a fixed pivot point 18, being a pivot point fast with frame 4.

As will be explained, the foot 20 and the backstop member 16 facilitate the balanced transportation of steel coils of varying widths. Furthermore, the hook 2 remains level whether laden or unloaded.

Additionally, the adjustable foot is ideally suited to mandrel loading/unloading or close proximity coil storage as the foot 20 may be retracted for small width coils so that it may be readily maneuvered.

Figure 4:
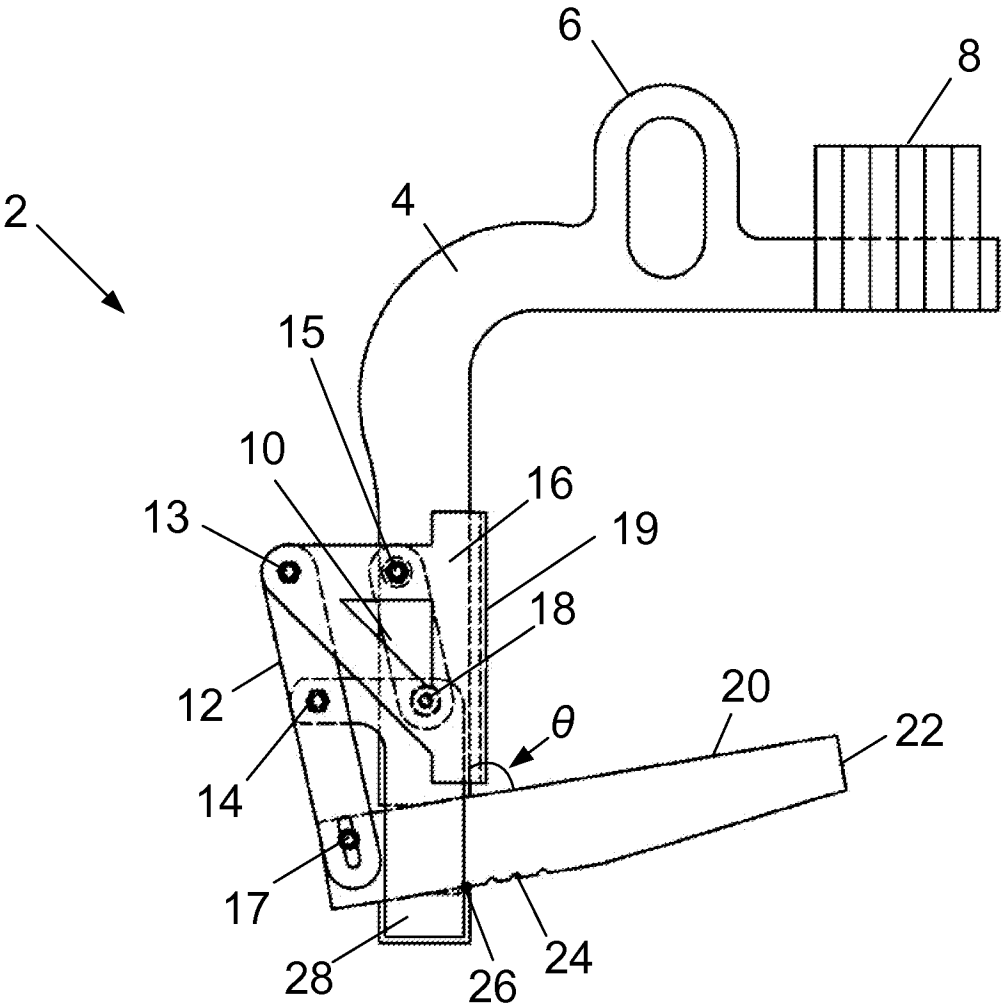
FIGS. 4 to 6 depict the C-hook progressively moving from the first configuration to a second configuration.
Figure 5:
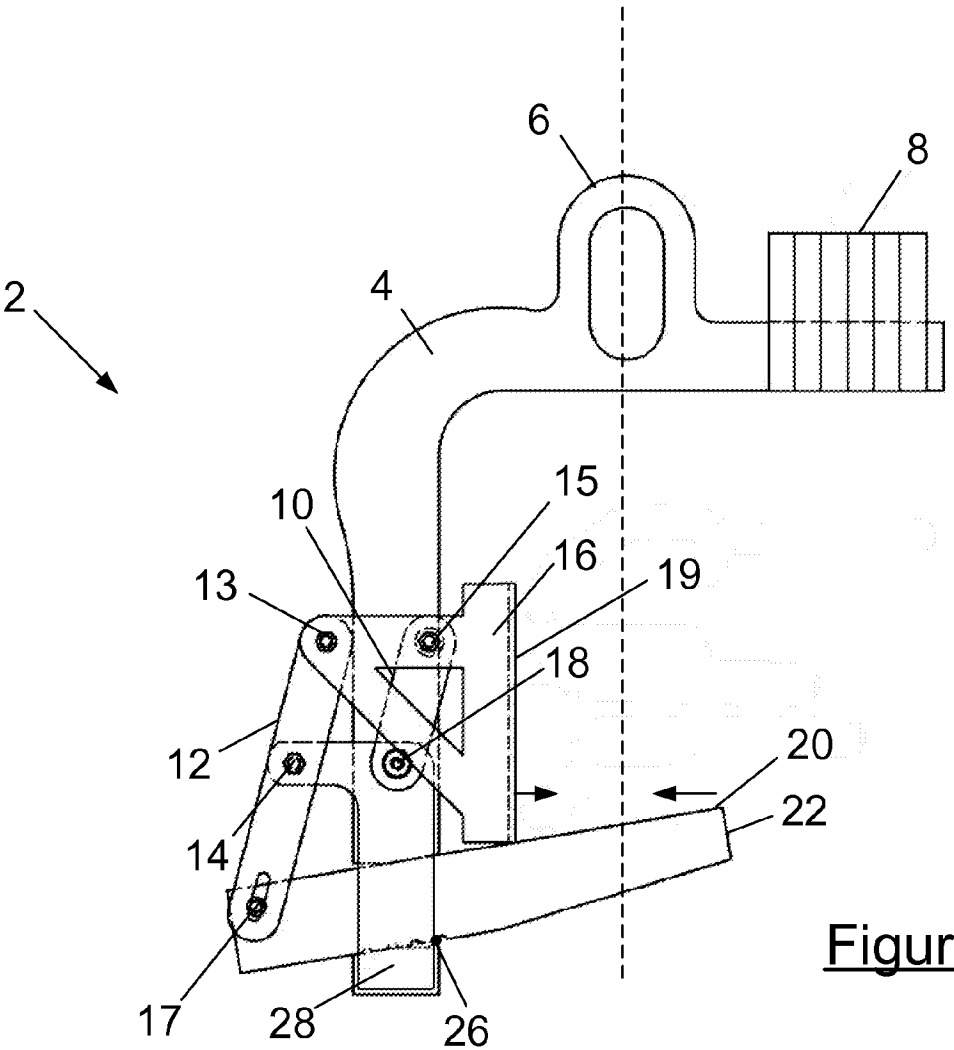

To adjust the foot 20 to suit a set coil width, the hook is raised in an unladen condition to a suitable height to allow the operator access to the adjustable foot. The operator lifts the hook front 22 so that it assumes the attitude shown in FIG. 4, thereby disengaging the location detent 24 from the location pin 26. The foot 20 is then slid in or out along the hook slide 28. This in-turn, by virtue of lever arm 12 and link arm 10, moves the interlinked coil backstop in the opposite direction as indicated by the opposed arrowheads in FIG. 5. That is the front end 22 of adjustable foot 20 and backstop member 16 move in concert, in opposite directions toward a vertical line through lifting point 6.

Figure 6:
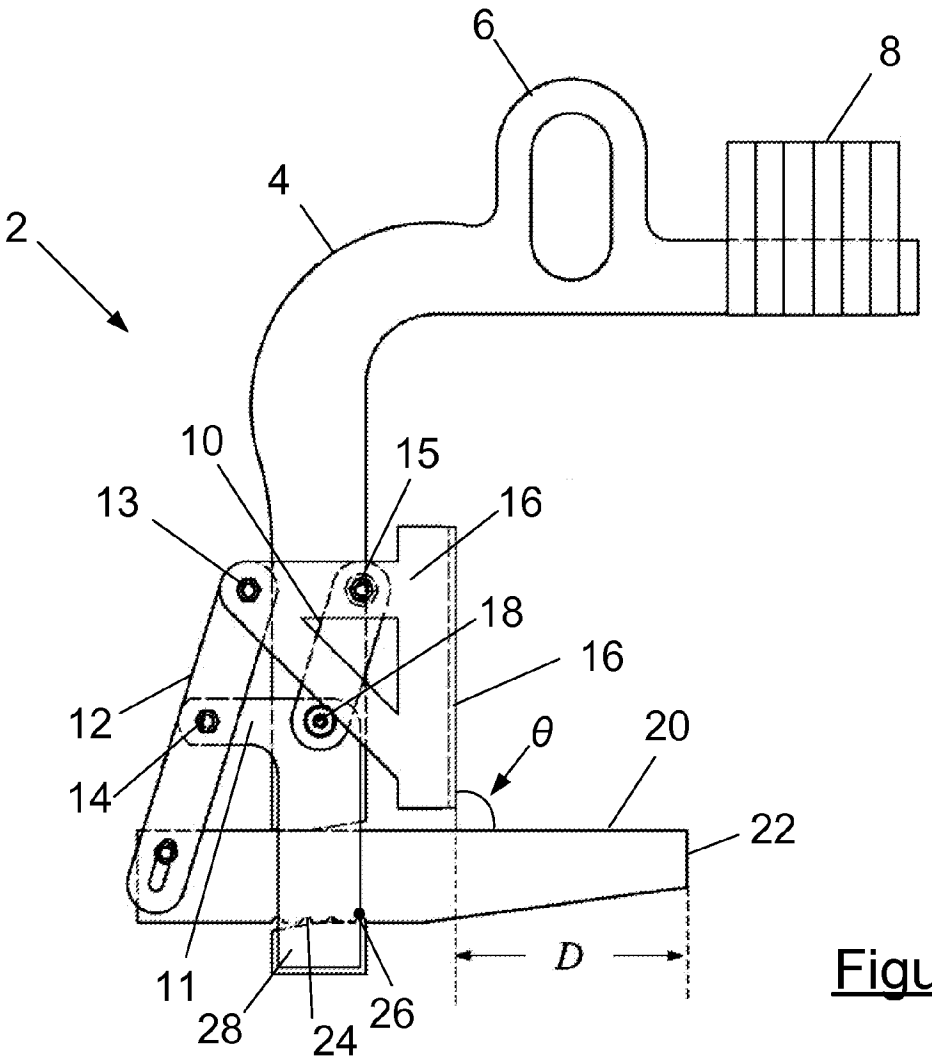

The adjustable foot 20 is then lowered such that the correct location detent to suit the coil width sits on the location pin as shown in FIGS. 6 and 7. The hook is now ready to pick up a coil which has the same width D as the distance from the foot front to the front of the interlinked coil backstop. It will be noted that due to the parallelogram defined by pivot points 18, 14, 13, 15 (identified in FIGS. 6 and 7) and the members connected therebetween comprising the mechanical linkage, the forward abutment face of the backstop member 16 maintains a constant angle θ, which is preferably 90 degrees to the foot 20, as it proceeds from the first position of FIG. 1 to the second position shown in FIG. 6.

It will be realized that the hook that has been described with reference to the Figures always remains horizontal in an unladen condition (other than during adjustment) because the mass moment created by the adjustable foot is counteracted by the mass moment of the interlinked coil backstop.

Additionally, the hook always remains horizontal in a laden condition because the centre of the combined mass of the hook and steel coil is directly below the lifting point, when the coil is placed against the backstop.

A hook according to a preferred embodiment of the present invention has a number of advantages as follows:

1) Suitable for an array of coil widths.
2) No protruding foot beyond the front of the coil, irrespective of coil width.
3) Always horizontal whether laden or unladen (or slightly biased backwards dependant on customer requirements).
4) Simple and quick adjustment, without tools.
5) Positive backstop removes guesswork on picking up coils correctly.
6) Able to lift coils of any weight up to stated WLL and remain horizontal.

In compliance with the statute, the invention has been described in language more or less specific to structural or methodical features. The term "comprises" and its variations, such as "comprising" and "comprised of" is used throughout in an inclusive sense and not to the exclusion of any additional features.

It is to be understood that the invention is not limited to specific features shown or described since the means herein described comprises preferred forms of putting the invention into effect.

For example, in the preferred embodiment of the invention described herein a mechanical linkage is provided for moving the back stop and the support arm in concert. However, in a less preferred embodiment the linkage may be omitted so that the back stop might merely be slid by an operator to a desired position, independent of the support arm which, in this less preferred embodiment, is fixed to the frame.

In a further embodiment both the support arm and the backstop member may be independently moveable relative to the frame so that an operator must move both the backstop member and the support arm for balancing.

In yet another embodiment the linkage may not include the link arm, or some other member, for example, so that the mechanical linkage does not describe a parallelogram of linkage points.

In that event the forward face of the backstrap member will not maintain a constant angle as it moves forward or back from and toward the frame.

The invention is, therefore, claimed in any of its forms or modifications within the proper scope of the appended claims and Summary of Invention, appropriately interpreted by those skilled in the art.

What is claimed is:

1. A lifting hook for lifting a coil comprising:

a lifting frame having a lifting point;

an elongate coil support member supported by said frame and extendible and retractable relative thereto said support member having a forward end and a rear end wherein the forward end penetrates a lumen of the coil in use;

a lever arm pivoted about a point fast with the frame and having a first end linked to the rear end of said support member;

an extendible and retractable backstop member arranged to present a coil abutment face at a desired position relative to the lifting point for balancing said hook when loaded said backstop member being linked to a second end of the lever arm opposite the first end thereof; and a second arm with ends pivotally connected between said backstop member and a point fast with said frame;

wherein the backstop member, the lever arm and the second arm comprise a mechanical linkage describing a parallelogram whereby pivoting of the lever arm advances or retracts the coil abutment face while maintaining said face at a constant angle.

2. A lifting hook according to claim 1, wherein the frame further comprises a slide at a lower end thereof supporting the elongate coil support member.

3. A lifting hook according to claim 1, wherein the constant angle comprises a right angle between the coil abutment face and the support member in a loaded configuration.

4. A lifting hook according to claim 1, wherein engagement formations are formed on the elongate coil support member for selectively positioning the elongate coil support member relative to the lifting frame.

5. A lifting hook according to claim 1, including a counterweight arranged to balance the lifting hook about the lifting point.

6. A lifting hook according to claim 1, wherein the lifting point comprises a portion of the frame shaped to provide an integrated lifting point.

* * * * *